US006206404B1

(12) United States Patent
Buquet et al.

(10) Patent No.: US 6,206,404 B1
(45) **Date of Patent: *Mar. 27, 2001**

(54) SKI BOOT SAFETY BINDING

(75) Inventors: Thierry Buquet, Varennes Vauzelles; André-Jean Kruajitch, Nevers, both of (FR)

(73) Assignee: Look Fixations SA, Nevers (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/103,853

(22) Filed: Jun. 24, 1998

(30) Foreign Application Priority Data

Jun. 26, 1997 (FR) ..... 97 08313

(51) Int. Cl.[7] ..... A63C 9/085; A63C 9/10
(52) U.S. Cl. ..... 280/624; 280/629; 280/628
(58) Field of Search ..... 280/624, 625, 280/628, 636, 629

(56) References Cited

U.S. PATENT DOCUMENTS

| | | | | |
|---|---|---|---|---|
| 3,027,173 | | 3/1962 | Beyl | 280/628 |
| 3,173,701 | * | 3/1965 | Beyl | 280/626 |
| 3,194,574 | | 7/1965 | Beyl | 280/628 |
| 4,166,636 | | 9/1979 | Svoboda et al. | 280/625 |
| 4,401,318 | | 8/1983 | Beyl | 280/630 |
| 4,621,829 | | 11/1986 | Krob et al. | 280/628 |
| 4,758,017 | | 7/1988 | Stritzl et al. | 280/626 |
| 4,863,186 | | 9/1989 | Rullier et al. | 280/626 |
| 5,092,621 | | 3/1992 | Horn | 280/626 |
| 5,713,594 | * | 2/1998 | Jenni | 280/624 |
| 5,913,531 | | 6/1999 | Buquet | 280/626 |

FOREIGN PATENT DOCUMENTS

| | | |
|---|---|---|
| 2 502 019 | 9/1982 | (FR) . |
| 2 510 019 | 2/1983 | (FR) . |

* cited by examiner

*Primary Examiner*—Michael Mar
*Assistant Examiner*—Hau Phan
(74) *Attorney, Agent, or Firm*—Pitney, Hardin, Kipp & Szuch, LLP

(57) ABSTRACT

The heel piece of a safety binding for a ski boot, comprising a tubular binding body which is linked to a sole grip (1*a*) and is articulated about a transverse cam forming part of a stirrup piece linked to a pivoting plate mounted on a rail, along which rail this plate can be positioned by rear-operated positioning means. The body contains at least one spring which works in compression between a piston bearing on the cam and a stop linked to or consisting of a setting screw. The cam is formed in a cylindrical part which serves as a rotation pin for the body and has a flat extending parallel to the axis of said cylindrical part, with the piston bearing on this flat when the heel piece is closed. The cam has a second flat or a stop limiting the tilting of the binding body when the heel piece is being opened.

5 Claims, 5 Drawing Sheets

SKI BOOT SAFETY BINDING

FIELD OF THE INVENTION

The invention relates to a heel piece of a safety binding for holding the boot on a ski, comprising a tubular binding body which is rigidly linked to a sole grip and is articulated about a transverse cam forming part of a stirrup piece linked to a pivoting plate mounted on a rail, along which rail this plate can be positioned by rear-operated positioning means, the binding body containing at least one spring which works in compression between a piston bearing on the cam and a stop linked to or consisting of a setting screw, the cam being formed in a cylindrical part which serves as a rotation pin for the body and has a flat extending parallel to the axis of said cylindrical part, with the piston bearing on this flat when the heel piece is closed.

PRIOR ART

A heel piece of this type is described in patent CH 397 500 and has been used for a number of years by the applicant. The positioning means generally consist of a longitudinal screw engaging with cycloid teeth on the rail, this screw being operated by a screwdriver.

When this heel piece is open, the piston bears on the cylindrical part of the cam. The binding body can therefore tilt until it touches the ski and thus impair access to the means for setting the position of the heel piece on its rail.

SUMMARY OF THE INVENTION

The principal object of the invention is to limit the extent to which the heel piece opens, so as to leave free access to the means for setting the position of the heel piece on its rail.

To this effect, the heel piece according to the invention is one wherein the zone of the cam on which the piston bears when the heel piece is open is formed in such a way as to limit the tilting of the binding body when the heel piece is being opened.

According to a first embodiment, said zone consists of a second flat, smaller than the first flat but sufficient to hold the binding body by virtue of the strong force exerted by the spring in this position. This position is also stable, and the effect of this is to prevent abrupt accidental closure of the heel piece in the event of impact on the binding body.

According to a second embodiment, said zone of the cam has a projection which limits the rotation of the cam relative to the piston. This projection may have a plane face tensioned to the cylindrical part of the cam. This plane face therefore constitutes a flat whose presence will not be noticed when the binding is being closed, unlike a true secant flat according to the first embodiment.

DESCRIPTION OF THE DRAWINGS

The appended drawing represents three embodiments of the heel piece according to the invention by way of example.

DESCRIPTION OF THE PREFERRED EMBODIMENTS

Figure 1:
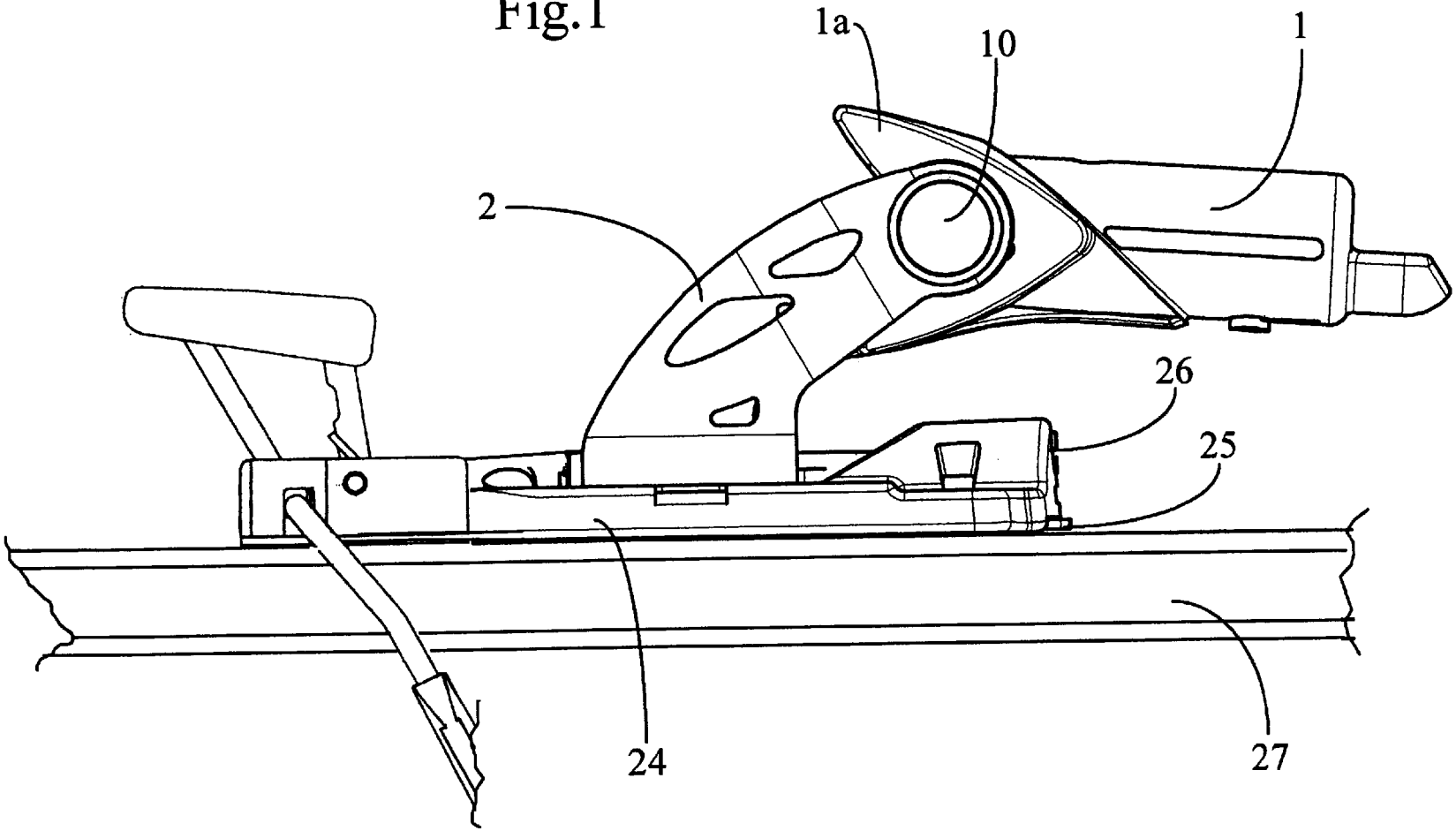
FIG. 1 is a side view of the heel piece when it is open.
Figure 2:
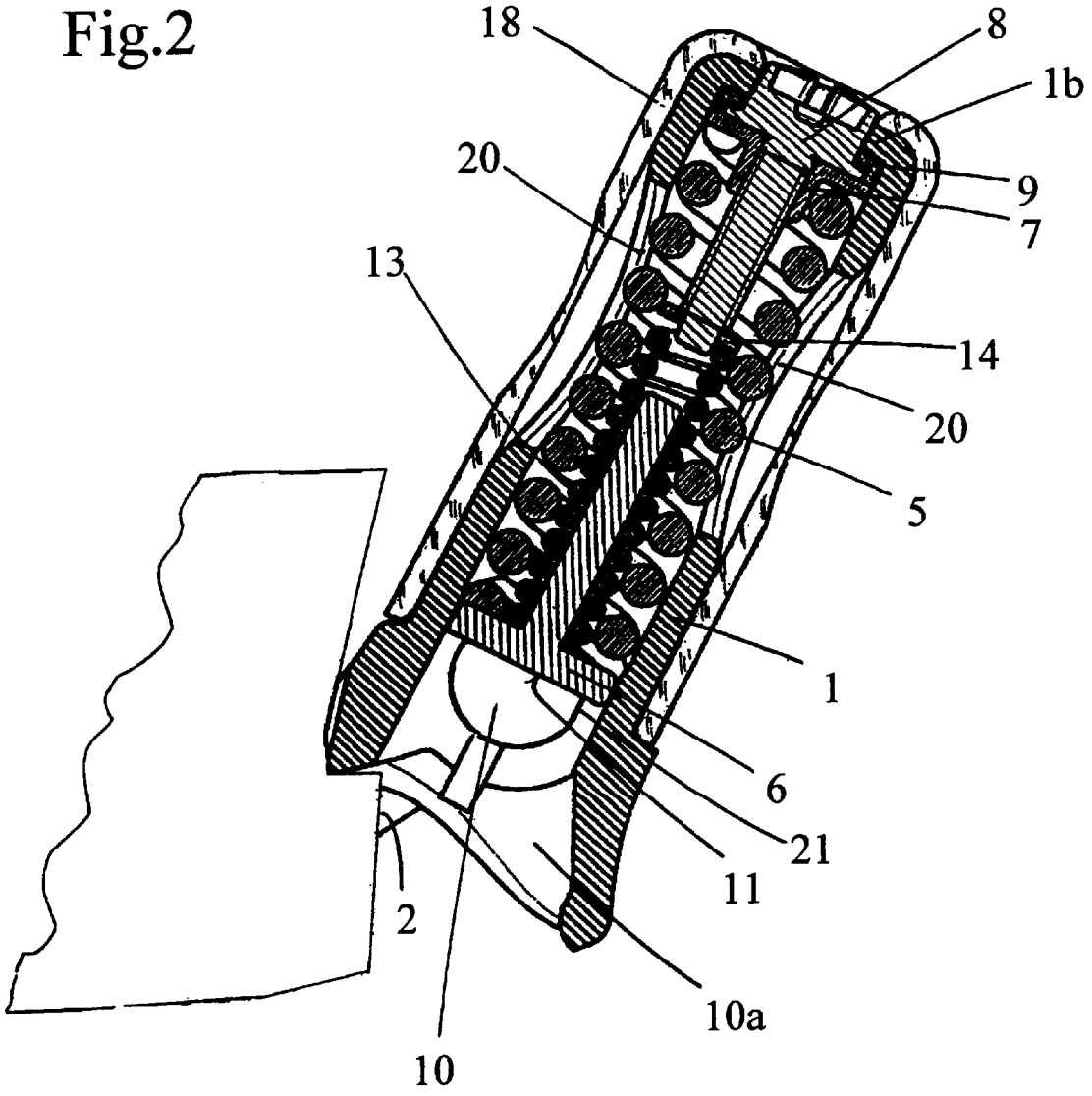
FIG. 2 is a view in axial section, on a vertical plane, of the binding body represented in FIG. 1 when it is closed, according to a first embodiment.
Figure 3:
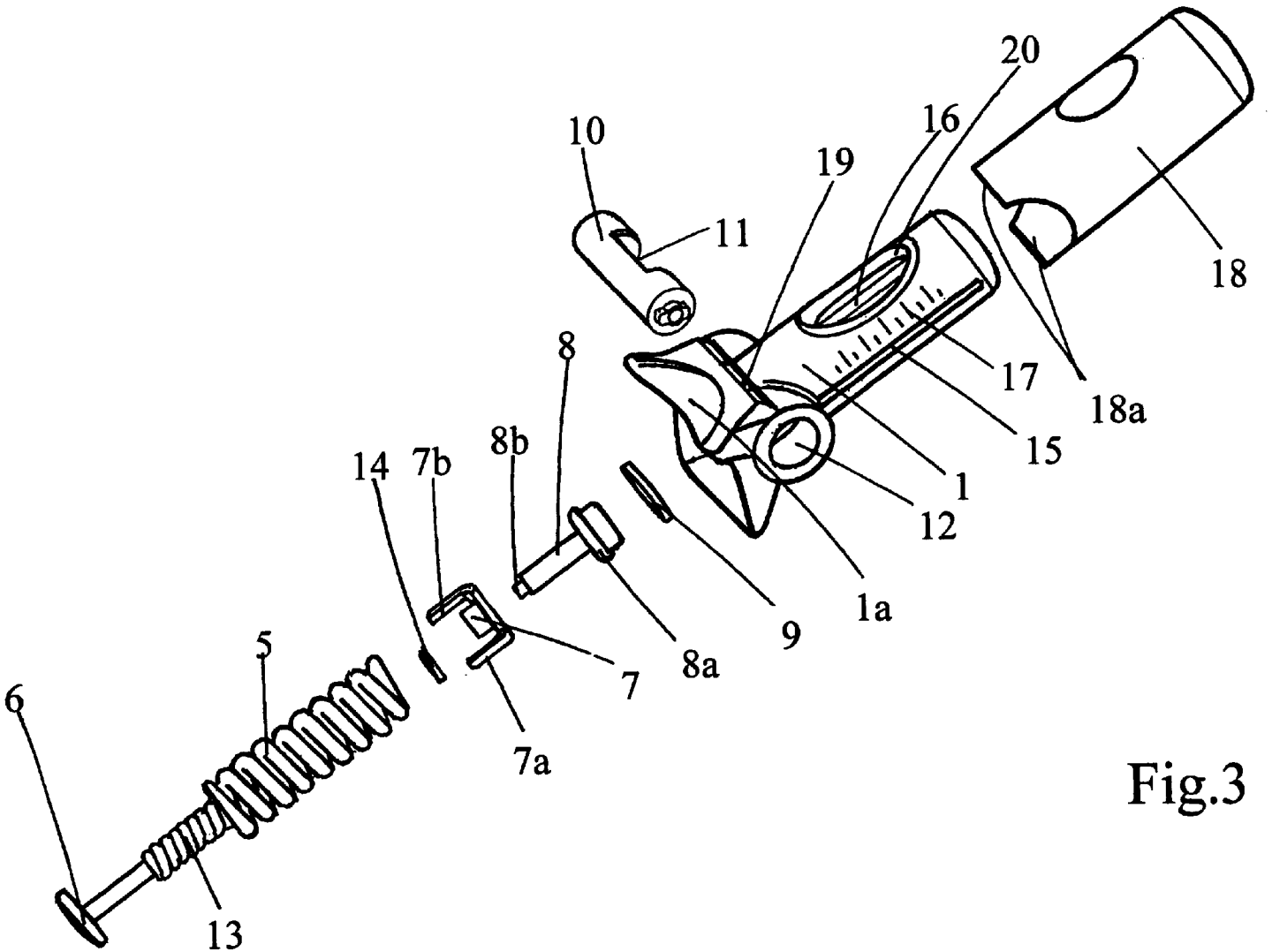
FIG. 3 is an exploded view of the body of the binding represented in FIG. 2.

Like the binding described in patent CH 397 500, the binding which is represented is characterized by a tubular cylindrical body 1 is formed integrally with a heel grip 1*a*. This body 1 is articulated about a cam 10 which forms part of a U-shaped stirrup piece 2 linked to a base plate 4 which is mounted so as to pivot in known fashion on a base 24 which is itself mounted on a rail 25, on which it can be moved by means of a screw 26 which is linked to the base and engages with teeth on the rail. The rail is attached to a ski 27. The body 1 is open at its two ends, that is to say it is also open on the side where the heel grip 1*a* is located. It contains a main coil spring 5, working in compression between a piston 6 and a stop 7 in the form of a nut mounted on a screw 8 which is provided with a collar 8*a* by which the screw bears on a bearing zone 1*b* of the body 1, this bearing zone 1*b* surrounding the upper opening of the body 1. A sliding washer 9 is interposed between the collar 8*a* and the bearing zone 1*b*. The piston 6 bears on the cam 10 which is in the general form of a cylindrical pin, passes diametrically through the body 1 and has a central part, constituting the cam proper, on which there is a flat 11. The arms of the stirrup piece 2 are fixed to the ends of this cam 10 by parts which are profiled so as to prevent the cam 10 from rotating. The body 1 has a bore 12 in order for it to rotate about the cam 10. An auxiliary spring 13 is also mounted inside the spring 5, and works in compression between the piston 6 and a washer 14 held on a bearing zone 8*b* of the end of the screw 8.

The body 1 also has two longitudinal slots 15 and 16 which are parallel to the axis of the springs and of the screw, and are arranged on each side of the body 1. The stop 7 is provided with two arms 7*a* and 7*b* which are engaged in the slot 15 or 16, respectively, and can slide freely in these slots. Graduations 17 are engraved at the edges of the slots and make it possible to read the position of the cursor which the nut 7 constitutes.

The cylindrical body 1 is surrounded by a cover 18 made of a synthetic material which is transparent at least in the zone for reading the display of the setting.

According to a first embodiment, the cam 10 has a shallow auxiliary flat 21 perpendicular to the main flat 11.

Figure 4:
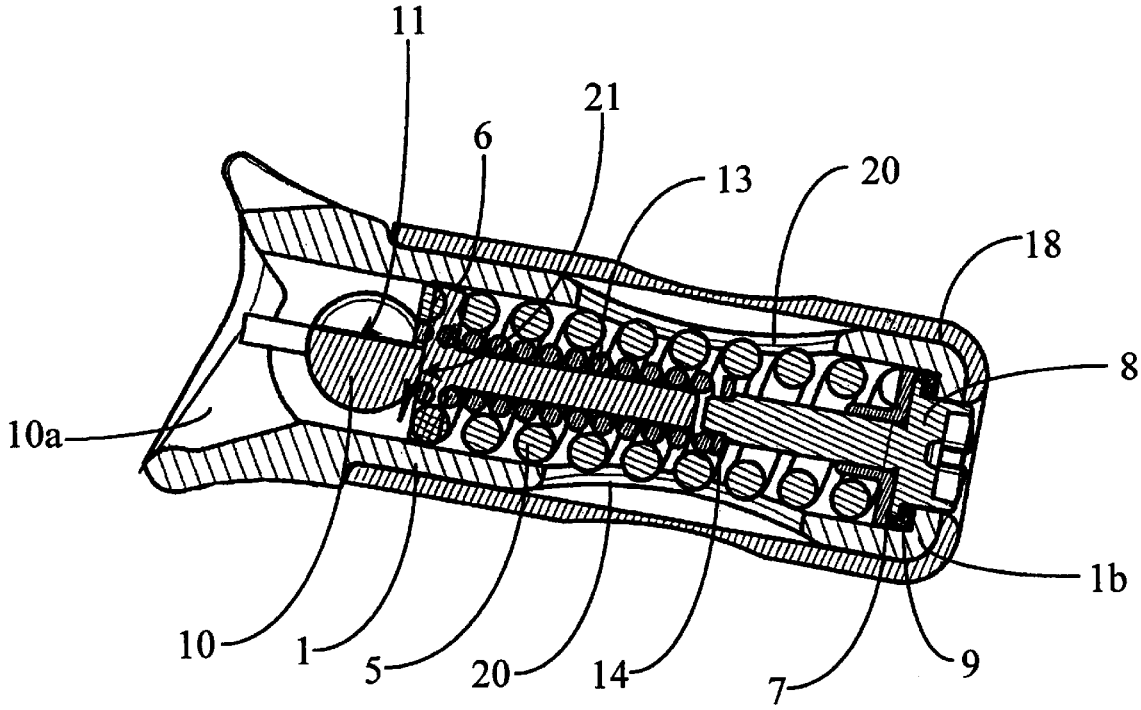
FIG. 4 represents the body of the heel piece in FIG. 2, when it is open.

As is known from the prior art, the heel piece is opened by tilting the body 1 about the cam 10, the effect of which is to push back the piston 6 and compress the springs, as represented in FIG. 4. When the piston comes to bear on the auxiliary flat 21, it is held in this stable position by the force of the springs. Although it is indeed possible to continue beyond this position, this requires particular effort. The body 1 occupies the position represented in FIG. 1. In this position, the space left between the body 1 and the ski 27 ensures good access to the setting screw 26.

Figure 5:
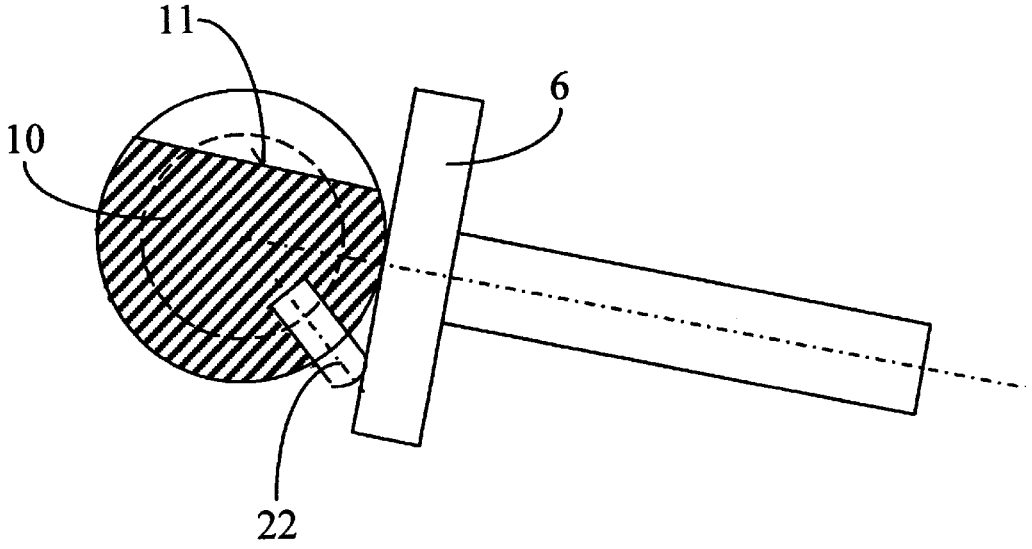
FIG. 5 represents the cam and the piston when the heel piece is open, according to a second embodiment.

According to a second embodiment, which is represented in FIG. 5, the cam 10 has a radial projection 22 which forms an angle of about 35° with the plane of the flat 11, the latter being slightly further away from the center of the cam than in the first embodiment. When the binding is being opened, the tilting of the body of the binding 1 is limited by the fact that the piston 6 abuts against the projection 22. The projection may be attached or formed integrally with the cam 10.

Figure 6:
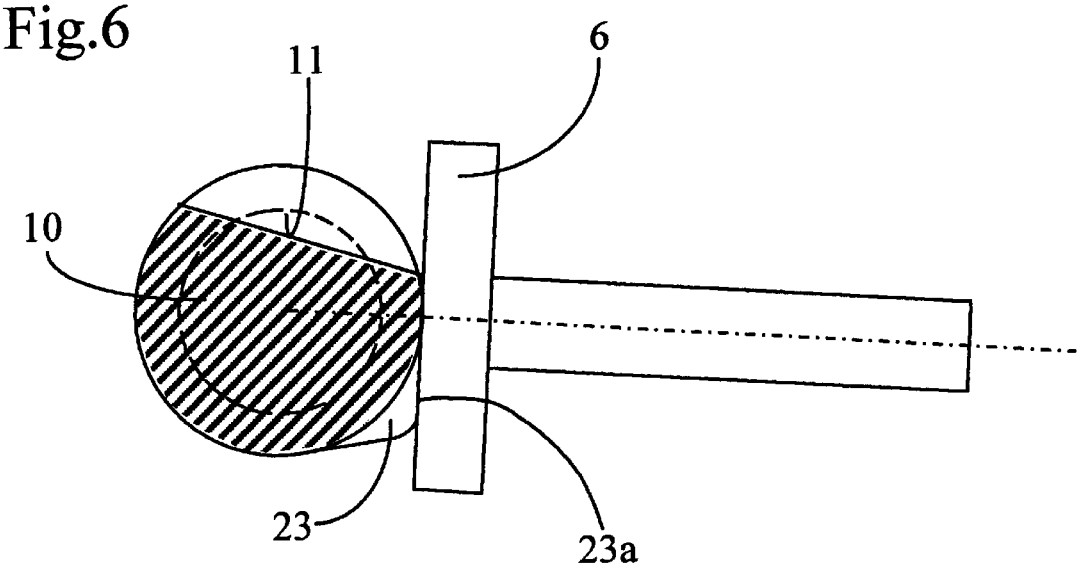
FIG. 6 represents the cam and the piston when the heel piece is open, according to a third embodiment.

In the embodiment represented in FIG. 6, the cam 10 is provided with a protuberance 23 which forms a plane bearing surface 23*a* tangent to the cylindrical surface of the cam. The diameter passing through the apex of the protuberance 23 forms an angle of about 25° with the flat 11. When the binding is being opened, the piston 6 comes to bear on the plane face of the protuberance 23.

In the embodiments according to FIGS. 5 and 6, the cam presents a high degree of resistance to rotation of the binding body beyond the position which is represented, while the binding can be closed starting from this position without encountering any particular resistance.

What is claimed is:

1. A heel piece of a safety binding for a ski boot, comprising a tubular binding body (1) which is connected to a sole grip (1*a*) and is articulated about a transverse cam (10) forming part of a stirrup piece which is linked to a pivoting plate mounted on a rail, along which rail this plate can be positioned by positioning means, the tubular binding body containing at least one spring (5) which works in compression between a piston (6) bearing upon the cam transverse and a stop (7) having a setting screw (8) for adjusting the piston bearing upon the cam, the transverse cam being formed by a cylindrical part (10) which serves as a rotation pin for the tubular binding body (1) and has a first zone comprising a substantially flat surface (11) extending parallel to an axis of said cylindrical part, with the piston (6) bearing on this flat surface when the heel piece is closed, and a second zone of the cam on which the piston bears when the heel piece is open, said second zone having at least two contact points that define a line which is other than parallel to said axis of the transverse cam, and which acts as a stop so as to limit rotational movement of the tubular binding body about the transverse cam so as to limit the tilting of the tubular binding body when the heel piece is being opened.

2. The heel piece as claimed in claim 1, wherein the second zone comprises a second flat surface (21), upon which the piston bears when the heel piece is open.

3. The heel piece as claimed in claim 2, wherein a depth of the second flat surface relative to the cylindrical surface is substantially less than that of the first flat surface.

4. The heel piece as claimed in claim 1, wherein the second zone comprises a projecting part (22, 23) which forms a stop for the piston.

5. The heel piece as claimed in claim 4, wherein said projecting part (23) forms a planar bearing face tangent to the cylindrical surface of the cam.

* * * * *